US008737857B2

(12) United States Patent
Kella et al.

(10) Patent No.: US 8,737,857 B2
(45) Date of Patent: May 27, 2014

(54) DETECTING COLORANTS WITHIN CARRIER LIQUID

(75) Inventors: Dror Kella, Nes-Ziona (IL); Doron Schlumm, Gan Yavne (IL); Ziv Gilan, Moshav kfar-Harif (IL); Michel Assenheimer, Kfar Sava (IL); Peter Forgacs, Givon HaHadasha (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 768 days.

(21) Appl. No.: 12/920,263

(22) PCT Filed: Mar. 1, 2008

(86) PCT No.: PCT/US2008/055575

§ 371 (c)(1), (2), (4) Date: Nov. 22, 2010

(87) PCT Pub. No.: WO2009/110880

PCT Pub. Date: Sep. 11, 2009

(65) Prior Publication Data

US 2011/0058837 A1 Mar. 10, 2011

(51) Int. Cl.
*G03G 15/10* (2006.01)
*G03G 15/08* (2006.01)

(52) U.S. Cl.
CPC ..... *G03G 15/0824* (2013.01); *G03G 15/0827* (2013.01); *G03G 15/105* (2013.01)
USPC ..... 399/64

(58) Field of Classification Search
CPC ..... G03G 15/0824; G03G 15/0827; G03G 15/105
USPC ..... 399/58, 62, 64
See application file for complete search history.

(56) References Cited

U.S. PATENT DOCUMENTS 4,690,564 A 9/1987 Morgenstern et al.
6,018,385 A 1/2000 Lampersberger et al.

(Continued)

FOREIGN PATENT DOCUMENTS

JP 05-052750 3/1993
JP 2007-136855 6/2007

(Continued)

OTHER PUBLICATIONS

International Search Report and Written Opinion for PCT/US2008/055575 dated Sep. 25, 2008 (9 pages).

(Continued)

*Primary Examiner* — Joseph S Wong

(57) ABSTRACT

A detecting apparatus is to at least assist in determining the concentration of colorants within a carrier liquid. The colorants at least absorb light and/or diverge light. The detecting apparatus includes one or more light sources to emit light, and one or more light detectors to detect light. The light sources and the light detectors are positionally configured in relation to one another such that both light directly emitted by the light sources and that has not been absorbed or diverged by the colorants, as well as light diverged by the colorants within the carrier liquid, are detected and/or determined. The concentration of colorants is determined based on the light directly emitted by the light sources that has not been absorbed or diverged by the colorants and/or on the light diverged by the colorants within the carrier liquid.

22 Claims, 6 Drawing Sheets

(56) References Cited

U.S. PATENT DOCUMENTS

| | | | | |
|---|---|---|---|---|
| 6,036,298 | A | 3/2000 | Walker | |
| 6,278,850 | B1 * | 8/2001 | Park | 399/57 |
| 6,322,192 | B1 | 11/2001 | Walker | |
| 6,400,099 | B1 | 6/2002 | Walker | |
| 6,446,555 | B1 | 9/2002 | Schramm et al. | |
| 6,564,714 | B2 | 5/2003 | Brydges et al. | |
| 6,611,666 | B2 | 8/2003 | Regelsberger et al. | |
| 6,865,833 | B2 | 3/2005 | Kliakhandler et al. | |
| 7,643,766 | B2 * | 1/2010 | Horiuchi et al. | 399/57 |
| 2002/0104457 | A1 | 8/2002 | Brydges et al. | |
| 2003/0007804 | A1 | 1/2003 | Regelsberger et al. | |
| 2005/0068390 | A1 | 3/2005 | Katayama | |
| 2005/0156984 | A1 | 7/2005 | Uejima et al. | |
| 2005/0214015 | A1 | 9/2005 | Friedrich | |
| 2007/0064234 | A1 | 3/2007 | Tatarczyk et al. | |

FOREIGN PATENT DOCUMENTS

| | | |
|---|---|---|
| KR | 1999-0018753 | 3/1999 |
| KR | 2000-0018741 | 4/2000 |

OTHER PUBLICATIONS

International Preliminary Report on Patentability for International Appln. No. PCT/US2008/055575 dated Sep. 16, 2010 (5 pages).

* cited by examiner

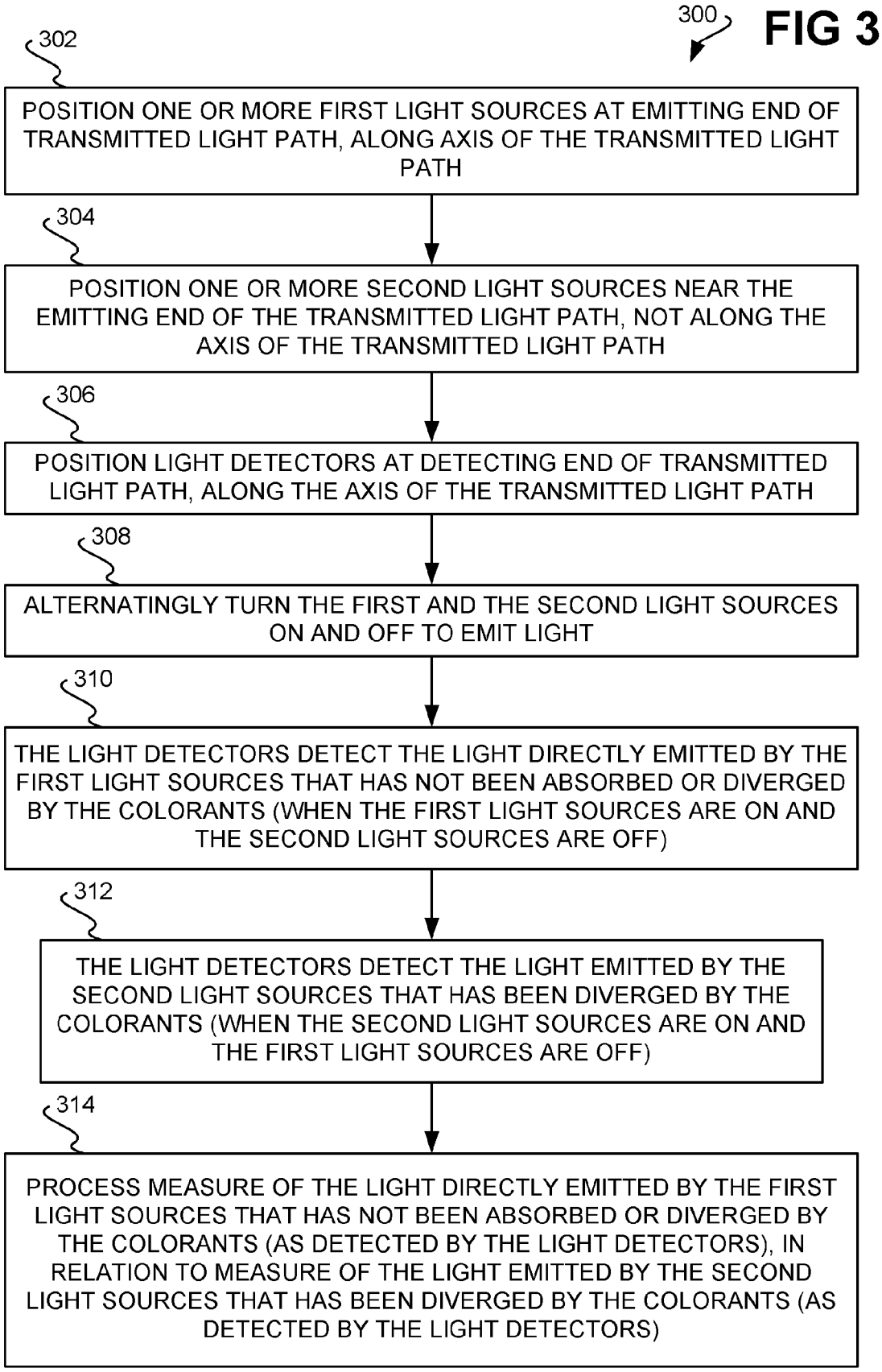
300
FIG 3
302
POSITION ONE OR MORE FIRST LIGHT SOURCES AT EMITTING END OF TRANSMITTED LIGHT PATH, ALONG AXIS OF THE TRANSMITTED LIGHT PATH
304
POSITION ONE OR MORE SECOND LIGHT SOURCES NEAR THE EMITTING END OF THE TRANSMITTED LIGHT PATH, NOT ALONG THE AXIS OF THE TRANSMITTED LIGHT PATH
306
POSITION LIGHT DETECTORS AT DETECTING END OF TRANSMITTED LIGHT PATH, ALONG THE AXIS OF THE TRANSMITTED LIGHT PATH
308
ALTERNATINGLY TURN THE FIRST AND THE SECOND LIGHT SOURCES ON AND OFF TO EMIT LIGHT
310
THE LIGHT DETECTORS DETECT THE LIGHT DIRECTLY EMITTED BY THE FIRST LIGHT SOURCES THAT HAS NOT BEEN ABSORBED OR DIVERGED BY THE COLORANTS (WHEN THE FIRST LIGHT SOURCES ARE ON AND THE SECOND LIGHT SOURCES ARE OFF)
312
THE LIGHT DETECTORS DETECT THE LIGHT EMITTED BY THE SECOND LIGHT SOURCES THAT HAS BEEN DIVERGED BY THE COLORANTS (WHEN THE SECOND LIGHT SOURCES ARE ON AND THE FIRST LIGHT SOURCES ARE OFF)
314
PROCESS MEASURE OF THE LIGHT DIRECTLY EMITTED BY THE FIRST LIGHT SOURCES THAT HAS NOT BEEN ABSORBED OR DIVERGED BY THE COLORANTS (AS DETECTED BY THE LIGHT DETECTORS), IN RELATION TO MEASURE OF THE LIGHT EMITTED BY THE SECOND LIGHT SOURCES THAT HAS BEEN DIVERGED BY THE COLORANTS (AS DETECTED BY THE LIGHT DETECTORS)

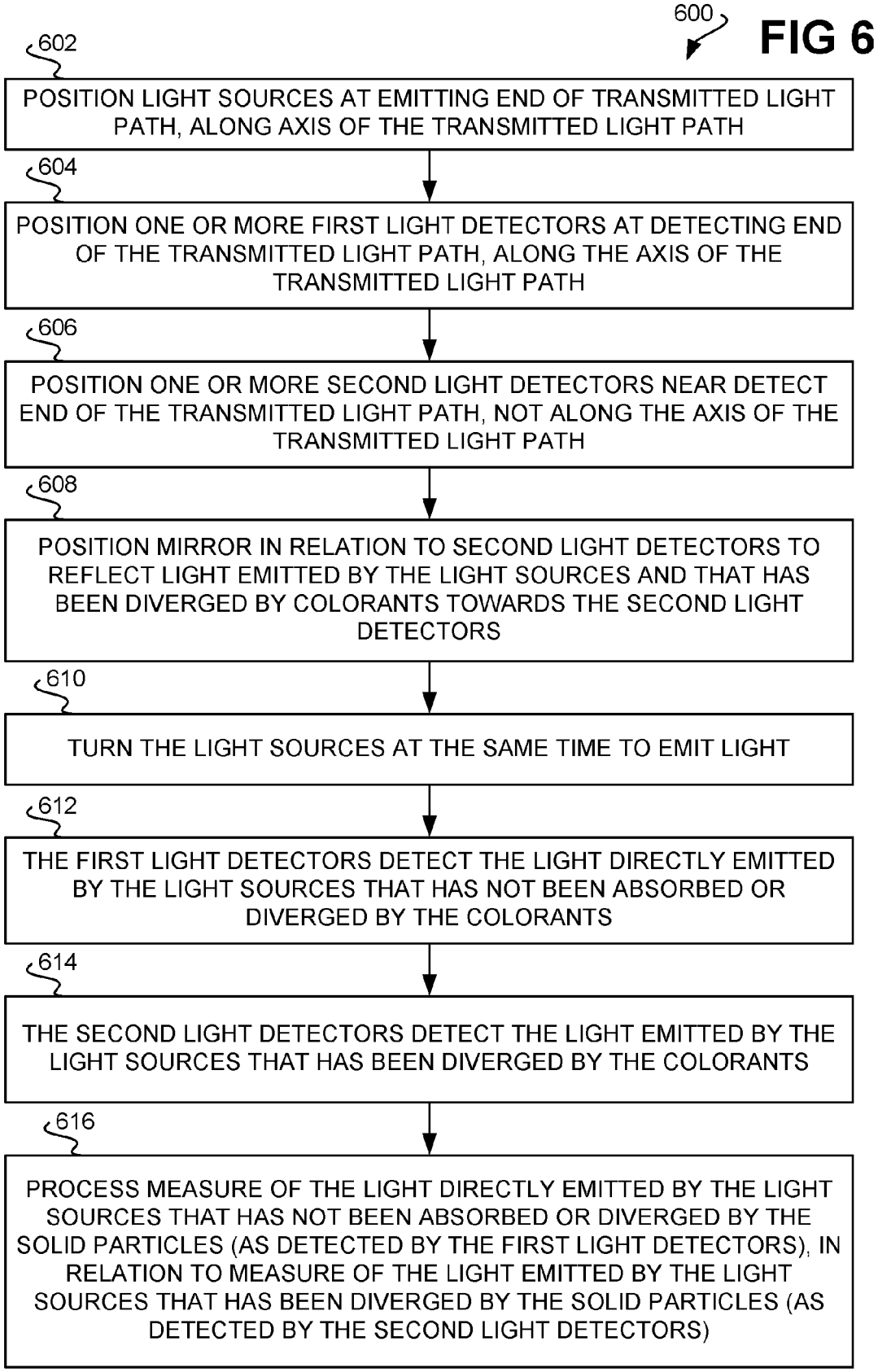
600
FIG 6
602
POSITION LIGHT SOURCES AT EMITTING END OF TRANSMITTED LIGHT PATH, ALONG AXIS OF THE TRANSMITTED LIGHT PATH
604
POSITION ONE OR MORE FIRST LIGHT DETECTORS AT DETECTING END OF THE TRANSMITTED LIGHT PATH, ALONG THE AXIS OF THE TRANSMITTED LIGHT PATH
606
POSITION ONE OR MORE SECOND LIGHT DETECTORS NEAR DETECT END OF THE TRANSMITTED LIGHT PATH, NOT ALONG THE AXIS OF THE TRANSMITTED LIGHT PATH
608
POSITION MIRROR IN RELATION TO SECOND LIGHT DETECTORS TO REFLECT LIGHT EMITTED BY THE LIGHT SOURCES AND THAT HAS BEEN DIVERGED BY COLORANTS TOWARDS THE SECOND LIGHT DETECTORS
610
TURN THE LIGHT SOURCES AT THE SAME TIME TO EMIT LIGHT
612
THE FIRST LIGHT DETECTORS DETECT THE LIGHT DIRECTLY EMITTED BY THE LIGHT SOURCES THAT HAS NOT BEEN ABSORBED OR DIVERGED BY THE COLORANTS
614
THE SECOND LIGHT DETECTORS DETECT THE LIGHT EMITTED BY THE LIGHT SOURCES THAT HAS BEEN DIVERGED BY THE COLORANTS
616
PROCESS MEASURE OF THE LIGHT DIRECTLY EMITTED BY THE LIGHT SOURCES THAT HAS NOT BEEN ABSORBED OR DIVERGED BY THE SOLID PARTICLES (AS DETECTED BY THE FIRST LIGHT DETECTORS), IN RELATION TO MEASURE OF THE LIGHT EMITTED BY THE LIGHT SOURCES THAT HAS BEEN DIVERGED BY THE SOLID PARTICLES (AS DETECTED BY THE SECOND LIGHT DETECTORS)

DETECTING COLORANTS WITHIN CARRIER LIQUID

BACKGROUND

An electro-photography (EP) printing device forms an image on media typically by first selectively charging a photoconductive drum in correspondence with the image. Colorant is applied to the photoconductive drum where the drum has not been charged, and then this colorant is transferred to the media to form the image on the media. Traditionally, the most common type of EP printing device has been the laser printer, which is a dry EP (DEP) printing device that employs toner as the colorant in question. More recently, liquid EP (LEP) printing devices have become popular.

An LEP printing device employs ink, instead of toner, as the colorant that is applied to the photoconductive drum where the drum has been charged. The ink includes solid pigment particles within a carrier liquid. To ensure proper LEP printing, the concentration of the solid pigment particles within the carrier liquid is desirably maintained at a substantially constant level for a given type of ink. Thus, the concentration of the colorants within the carrier liquid is desirably measured.

BRIEF DESCRIPTION OF THE DRAWINGS

FIG. 3 is a flowchart of a method for using the detecting apparatus of FIG. 2 to determine the concentration of colorants within a carrier liquid, according to an embodiment of the present disclosure.

FIG. 6 is a flowchart of a method for using the detecting apparatus of FIG. 4 or FIG. 5 to determine the concentration of colorants within a carrier liquid, according to an embodiment of the present disclosure.

DETAILED DESCRIPTION OF THE DRAWINGS

Figure 1:
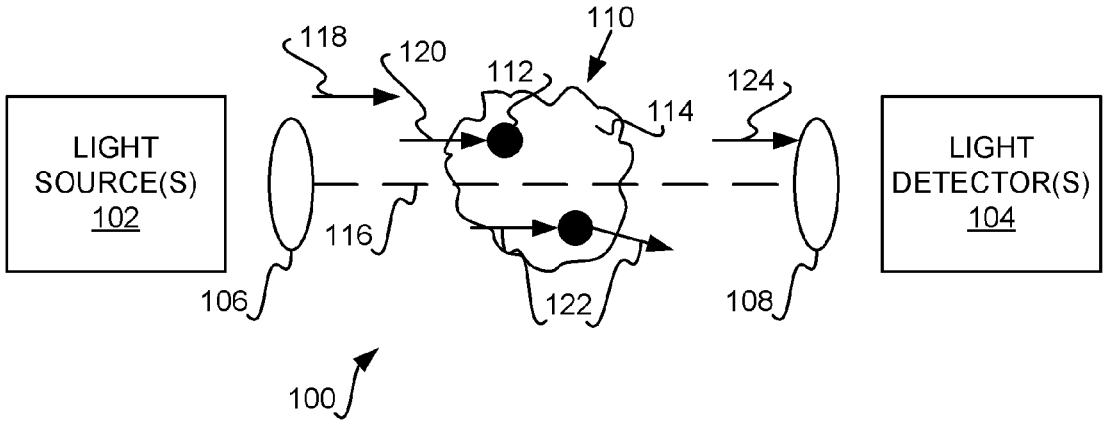
FIG. 1 is a diagram of a detecting apparatus to at least assist in determining the concentration of colorants within a carrier liquid, according to an embodiment of the present disclosure.

FIG. 1 shows a detecting apparatus 100 to at least assist in determining the concentration of colorants 112 within a carrier liquid 114, according to an embodiment of the present disclosure. The detecting apparatus 100 may be part of a liquid electro-photography (LEP) printing device. In such an embodiment, the colorants 112 and the carrier liquid 114 are part of ink 110 that is used by the LEP printing device to form images on media like paper in an LEP manner. The colorants

112 in this embodiment are particularly solid pigment particles that provide the ink 110 with its desired color, where the carrier liquid 114 of the ink 110 may be oil. The colorants 112 may be other types of colorants, however, such as non-solid dyes.

The detecting apparatus 100 of the embodiment of FIG. 1 includes one or more lenses 106 and one or more lenses 108. There is a transmitted light path, indicated by the arrow 118, that is defined between the lenses 106 and the lenses 108, and thus that is defined by the detecting apparatus 100 itself. The transmitted light path has an emitting end at which the lenses 106 are situated, and a detecting end at which the lenses 108 are situated. The transmitted light path denoted by the arrow 118 has a linear axis 116 between the lenses 106 and 108 as well.

The detecting apparatus 100 includes one or more light sources 102 and one or more light detectors 104. The light sources 102 may be light-emitting diodes (LED's), laser light sources, and/or other types of energy sources, such that the terminology light sources as used herein also encompasses energy sources like electron beams. The light sources 102 are positioned at or near the emitting end of the transmitted light path denoted by the arrow 118. The light detectors 104 may be photodiodes, and/or other types of energy detectors, where the terminology detectors as used herein encompasses energy detectors for detecting electron beams and other types of energy. The light detectors 104 are positioned at or near the detecting end of the transmitted light path denoted by the arrow 118. The light sources 102 emit light, while the light detectors 104 detect light.

The carrier liquid 114 containing the colorants 112 travels through the transmitted light path denoted by the arrow 118. For example, the carrier liquid 114, and thus the colorants 112, may be ejected through the plane of the sheet of FIG. 1, between the lenses 106 and 108 and thus through the transmitted light path denoted by the arrow 118. That is, if the x-axis (i.e., the axis 116) and the y-axis define the plane of FIG. 1, the carrier liquid 114 and the colorants 112 are ejected along the z-axis that is perpendicular to the plane of FIG. 1 Light emitted by the light sources 102, which may or may not be emitted along the transmitted light path denoted by the arrow 118 as is described later in the detailed description, may be affected or unaffected by the colorants 112 within the carrier liquid 114 in any of three different ways.

First, light that is directly emitted by the light sources 102 along the transmitted light path denoted by the arrow 118 may not encounter any of the colorants 112 within the carrier liquid 114, and therefore reaches the detecting end of the transmitted light path and is detected by the light detectors 104. This first scenario is representatively depicted in FIG. 1 by the arrow 124. Second, light that is directly emitted by the light sources 102 along the transmitted light path denoted by the arrow 118 may encounter and be absorbed by the colorants 112 within the carrier liquid 114. This second scenario is representatively depicted in FIG. 1 by the arrow 120. Light absorbed by the colorants 112 in this scenario do not reach the light detectors 104, and are not detected by the light detectors 104.

Third, light that is emitted by the light sources 102, either directly along the transmitted path denoted by the arrow 118 or indirectly and thus not along the transmitted path, may encounter and be diverged by the colorants 112 within the carrier liquid 114. This third scenario is representatively depicted in FIG. 1 by the arrows 122. In this scenario, light diverged by the colorants 112 may reach the light detectors 104, and thus may be detected by the light detectors 104. Divergence in this sense can mean that the light is fluoresced and/or scattered by the colorants 112. Scattering means that the light changes direction when encountering the colorants 112. Fluorescence means that the light changes forms of energy when encountering the colorants 112 and also changes its original direction.

Figure 2:
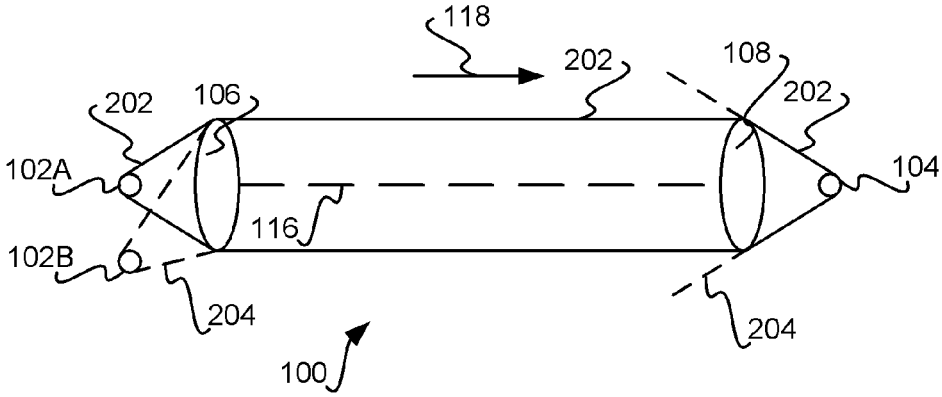
FIG. 2 is a diagram of the detecting apparatus of FIG. 1 in more detail, according to a specific embodiment of the present disclosure.

FIG. 2 shows the apparatus 100, according to a first specific embodiment of the present disclosure. In the embodiment of FIG. 2, the light sources 102 are divided into two groups: one or more first light sources 102A and one or more second light sources 102B. By comparison, in the embodiment of FIG. 2, the light detectors 104 have not been divided into separate groups.

The first light sources 102A are positioned at the emitting end of the transmitted light path denoted by the arrow 118, and more specifically along the axis 116 of the transmitted light path. This can mean, for instance, that the light sources 102A may be positioned at the focal point of the lenses 106, at the center of the lenses 106 from top to bottom in FIG. 2. The first light sources 102A therefore directly emit only light 202 that travels along the transmitted light path denoted by the arrow 118 except where the emitted light is absorbed or diverged by colorants. The first light sources 102A do not emit any light that does not travel along the transmitted light path denoted by the arrow 118, unless (i.e., except) of course the light emitted by the first light sources 102A is diverged or absorbed by colorants.

The second light sources 102B are positioned near the emitting end of the transmitted light path denoted by the arrow 118, and more specifically are not positioned along the axis 116 of the transmitted light path. This can mean, for instance, that the light sources 102B may be positioned off-center relative to the lenses 106 from top to bottom in FIG. 2, and may not be positioned at the focal point of the lenses 106. The second light sources 102B therefore emit light 204 that does not travel along the transmitted light path denoted by the arrow 118.

The light detectors 104 are positioned at the detecting end of the transmitted light path denoted by the arrow 118, and more specifically along the axis 116 of the transmitted light path. For instance, the light detectors 104 may be positioned at the focal point of the lenses 108, at the center of the lenses 108 from top to bottom in FIG. 2. The light detectors 104 detect the light 202 directly emitted by the first light sources 102A that has not been absorbed or diverged by colorants. The light detectors 104 also detect the light 204 emitted by the second light sources 102B that have been diverged by colorants towards the light detectors 104.

FIG. 3 shows a method 300 in relation to which the apparatus 100 of FIG. 2 can be used, according to an embodiment of the present disclosure. As has been described, the first light sources 102A are positioned at the emitting end of the transmitted light path denoted by the arrow 118, along the axis 116 of the transmitted light path (302). Likewise, the second light sources 102B are positioned near the emitting end of the transmitted light path denoted by the arrow 118, but not along the axis 116 of the transmitted light path (304). The light detectors 104 are positioned at the detecting end of the transmitted light path denoted by the arrow 118, also along the axis 116 of the transmitted light path (306).

Thereafter, the first light sources 102A and the second light sources 102B are alternatingly turned on and off (308). That is, when the first light sources 102A are turned on to emit the light 202, the second light sources 1026 are turned off and do not emit the light 204. Similarly, when the second light sources 1026 are turned on to emit the light 204, the first light sources 102A are turned off and do not emit the light 202. Thus, at any given time, either the first light sources 102A are on and the second light sources 1026 are off, or the first light sources 102A are off and the second light sources 1026 are on.

When the first light sources 102A are on and the second light sources 1026 are off, the light detectors 104 detect the light 202 directly emitted by the first light sources 102A along the transmitted path denoted by the arrow 118 and that has not been absorbed or diverged by colorants (310). The detection of this light may include measuring or providing a value corresponding to the intensity of the light detected. Similarly, when the first light sources 102A are off and the second light sources 1026 are on, the light detectors 104 detect the light 204 emitted by the second light sources 1026 that has been diverged by colorants towards the light detectors 104 (312). The detection of this light may also include measuring or providing a value corresponding to the intensity of the light detected.

The measure of the light 202 that has not been absorbed or diverged by colorants, as detected, is processed in relation to the measure of the light 204 that has been diverged by colorants, as detected (314). This process is achieved to at least assist in determining the concentration of the colorants within the carrier liquid, as is understood and can be appreciated by those of ordinary skill within the art. Embodiments of the present disclosure are not limited to the manner by which these measures of light are processed in relation to one another to at least assist in determining the concentration of the colorants within the carrier liquid.

Figure 4:
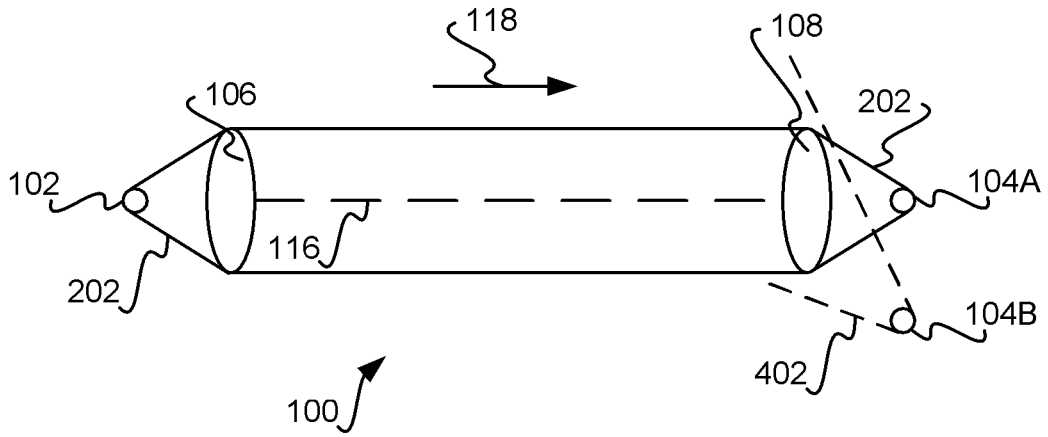
FIG. 4 is a diagram of the detecting apparatus of FIG. 1 in more detail, according to another specific embodiment of the present disclosure.
Figure 5:
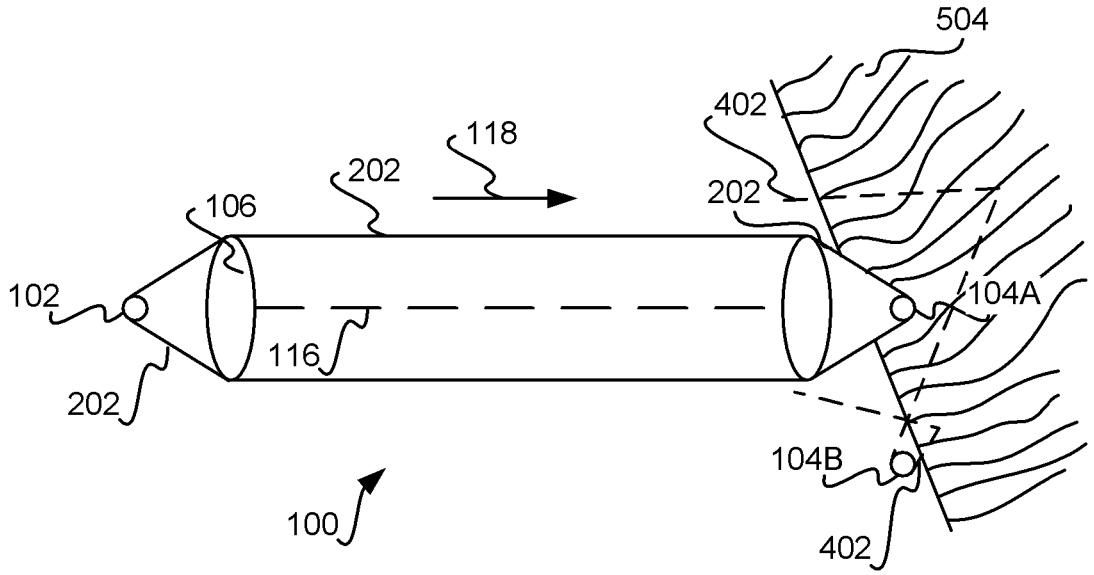
FIG. 5 is a diagram of the detecting apparatus of FIG. 1 in more detail, according to still another specific embodiment of the present disclosure.

FIG. 4 shows the apparatus 100, according to a second specific embodiment of the present disclosure, while FIG. 5 shows the apparatus 100, according to a third specific embodiment of the present disclosure. In the embodiments of FIGS. 4 and 5, the light detectors 104 are divided into two groups: one or more first light detectors 104A, and one or more second light detectors 104B. By comparison, in the embodiments of FIGS. 4 and 5, the light sources 102 have not been divided into separate groups. The difference between the embodiments of FIGS. 4 and 5 is that the embodiment of FIG. 5 includes a mirror 504, while the embodiment of FIG. 4 does not include a mirror.

The light sources 102 are positioned at the emitting end of the transmitted light path denoted by the arrow 118, and more specifically along the axis 116 of the transmitted light path. This can mean, for instance, that the light sources 102 may be positioned at the focal point of the lenses 106, at the center of the lenses 106 from top to bottom in FIGS. 4 and 5. The light sources 102 directly emit only light 202 that travels along the transmitted light path denoted by the arrow 118, except where the emitted light is absorbed or diverged by colorants. The light sources 102 do not emit any light that does not travel along the transmitted light path denoted by the arrow 118, unless (i.e., except) of course the light emitted by the first light sources 102A is diverged or absorbed by colorants.

The first light detectors 104A are positioned at the detecting end of the transmitted light path denoted by the arrow 118, and more specifically along the axis 116 of the transmitted light path. This can mean, for instance, that the first light detectors 104A may be positioned at the focal point of the lenses 108, at the center of the lenses 108 from top to bottom in FIGS. 4 and 5. The first light detectors 104A detect the light 202 directly emitted by the light sources 102 that has not been absorbed or diverged by colorants. The first light detectors 104A otherwise do not detect any light, such as any light that does not travel along the transmitted light path.

The second light detectors 104B are positioned near the detecting end of the transmitted light path denoted by the arrow 118, and more specifically are not positioned along the axis 116 of the transmitted light path. This can mean, for instance, that the second light detectors 104B may be positioned off-center relative to the lenses 108 from top to bottom in FIGS. 4 and 5. The second light detectors 104B detect the light emitted by the light sources 102 that has been diverged by colorants, which is indicated in FIGS. 4 and 5 as the light 402. The second light detectors 104B otherwise do not detect any light, such as the directly emitted light 202 that travels along the transmitted light path and that has not been absorbed or diverged by colorants.

In the embodiment of FIG. 5 specifically, the mirror 504 is positioned in relation to the second light detectors 104B to reflect the light that has been emitted by the light sources 102 and that has been diverged by colorants, which is indicated as the light 402, towards the second light detectors 104B. Thus, the embodiment of FIG. 5 may afford greater detection of the light 402 diverged by the colorants by the second light detectors 104B as compared to the embodiment of FIG. 4. This is because the mirror 504 reflects the light 402 diverged by the colorants towards the second light reflectors 104B in the embodiment of FIG. 5.

FIG. 6 shows a method 600 in relation to which the apparatus 100 of FIG. 4 or FIG. 5 can be used, according to an embodiment of the present disclosure. As has been described, the light sources 102 are positioned at the emitting end of the transmitted light path denoted by the arrow 118, along the axis 116 of the transmitted light path (602). The first light detectors 104A are positioned at the detecting end of the transmitted light path denoted by the arrow 118, also along the axis 116 of the transmitted light path (604). By comparison, the second light detectors 104B are positioned near the detecting end of the transmitted light path denoted by the arrow 118, and not along the axis 116 of the transmitted light path (606). In the embodiment of FIG. 5 specifically, the mirror 504 is positioned in relation to the second light detectors 104B to reflect light emitted by the light sources 102 and that has been diverged by colorants towards the second light detectors 104B, as has been described.

Thereafter, the light sources 102 are turned on at substantially the same time to emit light (610). The first light detectors 104A detect the light 202 that has been directly emitted by the light sources 102 along the transmitted path denoted by the arrow 118 and that has not been absorbed or diverged by colorants (612). The detection of this light may include measuring or providing a value corresponding to the intensity of the light detected. The second light detectors 1046 detect the light 402 that has been emitted by the light sources 102 but that has been diverged by colorants (614). The detection of this light may also include measuring or providing a value corresponding to the intensity of the light detected.

The measure of the light 202 that has not been absorbed or diverged by colorants, as detected, is processed in relation to the measure of the light 402 that has been diverged by colorants, as detected (314). This process is achieved to at least assist in determining the concentration of the colorants within the carrier liquid, as is understood and can be appreciated by those of ordinary skill within the art. As has been noted, embodiments of the present disclosure are not limited to the manner by which these measures of light are processed in relation to one another to at least assist in determining the concentration of the colorants within the carrier liquid.

Figure 7:
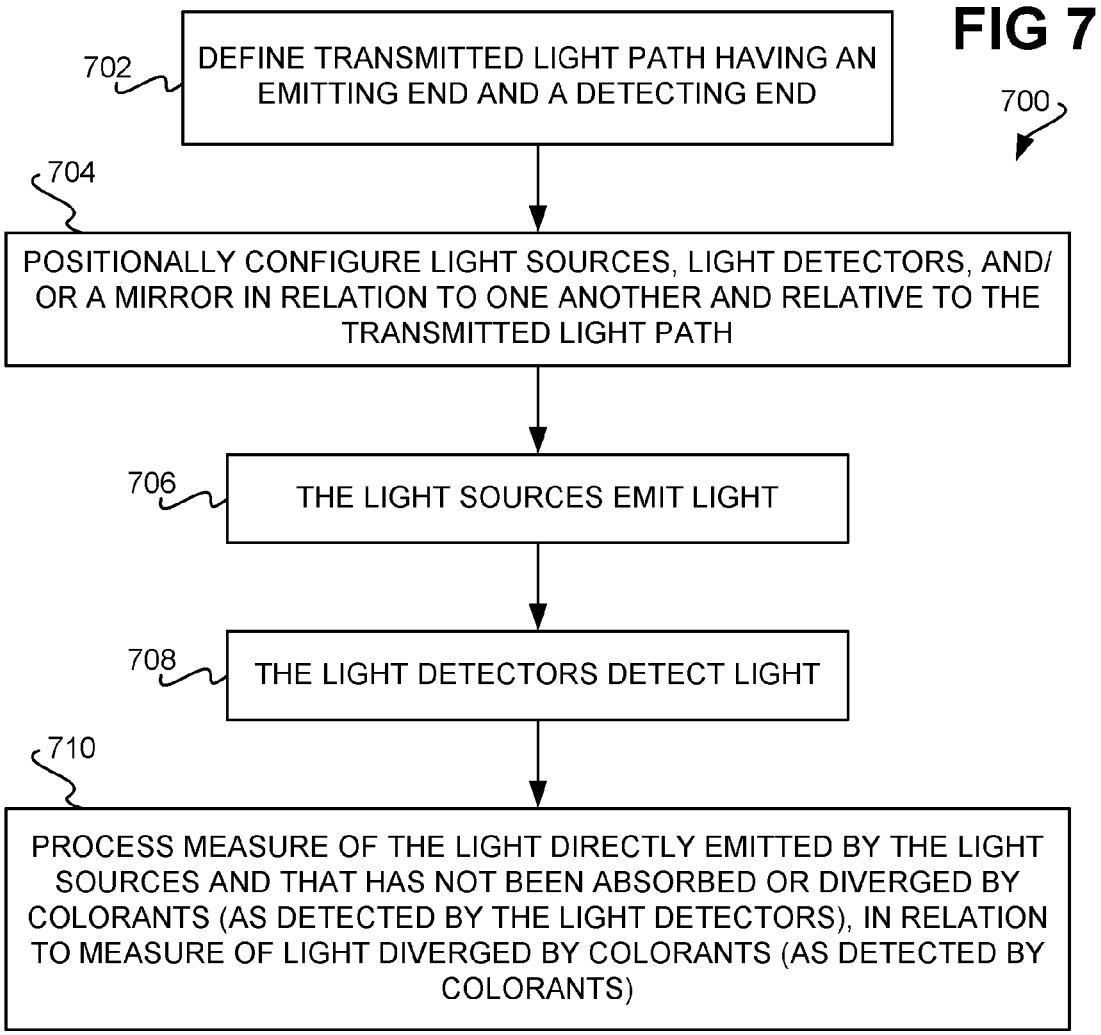
FIG. 7 is a flowchart of a method that encompasses and is more general than the methods of FIGS. 3 and 6, according to an embodiment of the present disclosure.

FIG. 7 shows a method 700 that summarizes the operation of the apparatus 100 of any of the embodiments of FIGS. 1, 2, 4, and 5, according to an embodiment of the disclosure. The method 700 thus encompasses and is more general than the method 300 of FIG. 3 and the method 600 of FIG. 6. A transmitted light path is defined as having an emitting end and a detecting end (702). Part 702 may include providing and positionally configuring the lenses 106 and 108 that have been described, for instance.

The light sources 102 and the light detectors 104 (as well as the mirror 504 in the embodiment of FIG. 5) are positionally configured in relation to one another relative to the transmitted light path that has been defined (704). Specifically, such positional configuration is achieved so that the light detectors 104 detect both the light directly emitted by the light sources 102 along the transmitted light path and that has not been absorbed by the colorants, as well as the light diverged by the colorants. Such positional configuration can be achieved in specific embodiments, for instance, as has been described in relation to FIG. 2, FIG. 4, and/or FIG. 5. Thus, part 704 encompasses parts 302, 304, and 306 of the method 300 of FIG. 3, as well as parts 602, 604, 606, and 608 of the method 600 of FIG. 6.

The light sources 102 then emit light (706), such as has been described in relation to part 308 of the method 300 of FIG. 3 or in relation to part 610 of the method 600 of FIG. 6. The light detectors 104 detect the light directly emitted by the light sources 102 along the transmitted light path and that has not been absorbed by the colorants, as well as the light diverged by the colorants (708). Thus, part 708 encompasses parts 310 and 312 of the method 300, as well as parts 612 and 614 of the method 600.

Finally, the measure of the light directly emitted along the transmitted light path that has not been absorbed or diverged by colorants, as detected, is processed in relation to the measure of the light that has been diverged by colorants, as detected (616). This process is achieved to at least assist in determining the concentration of the colorants within the carrier liquid, as is understood and can be appreciated by those of ordinary skill within the art. As has been noted, embodiments of the present disclosure are not limited to the manner by which these measures of light are processed in relation to one another to at least assist in determining the concentration of the colorants within the carrier liquid.

Figure 8:
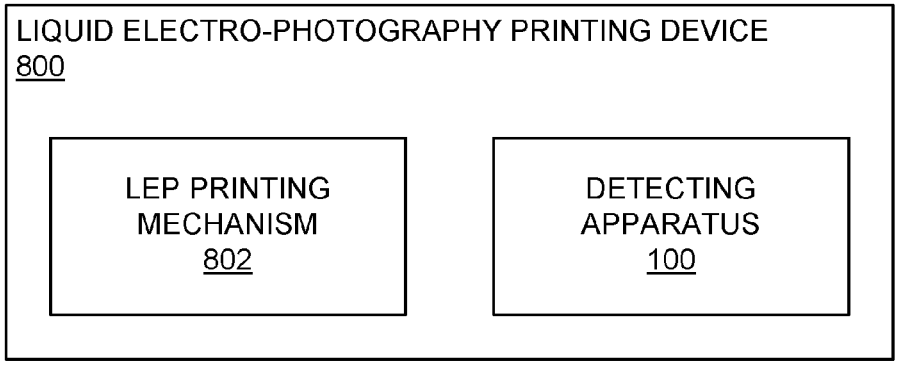
FIG. 8 is a block diagram of a liquid electro-photography (LEP) printing device that includes the detecting apparatus of FIG. 1, according to an embodiment of the present disclosure.

FIG. 8 shows a block diagram of a rudimentary LEP printing device 800, according to an embodiment of the present disclosure. The LEP printing device 800 can be a standalone printing device having just printing functionality, or a multiple-function device (MFD) or an all-in-one (AIO) device having other functionality, such as scanning, copying, and/or faxing functionality, in addition to having printing functionality. The LEP printing device 800 is depicted in FIG. 8 as including an LEP printing mechanism 802 and the detecting apparatus 100 of FIGS. 1, 2, 4, and/or 5 that has been described. Those of ordinary skill within the art can appreciate that the LEP printing device 800 may include other components, in addition to and/or in lieu of those depicted in FIG. 8.

The LEP printing mechanism 802 prints images on media like paper by using LEP, in relation to the ink 110 having the solid (pigment) particles 112 within the carrier liquid 110, as can be appreciated by those of ordinary skill within the art. For instance, the LEP printing mechanism 802 may include a binary ink developer and other components typically and/or commonly found within LEP printing devices like the LEP printing device 800. The colorants 112 absorb and/or diverge light.

The detecting apparatus 100 is thus used to at least assist in determining the concentration of the colorants 112 within the carrier liquid 114, by detecting a measure of light that passes through ink 110 without being absorbed or diverged by the colorants 112 and by detecting a measure of light that is diverged by the colorants 112. These measures of light can be processed in relation to one another to determine or calculate the concentration of the colorants 112 within the carrier liquid 114. In this way, the concentration of the colorants 112 within the carrier liquid 114 can be monitored, so that it is maintained at a substantially constant level for a given type of the ink 110 in order to ensure optimal and/or proper LEP printing by the LEP printing mechanism 802.

Figure 9A:
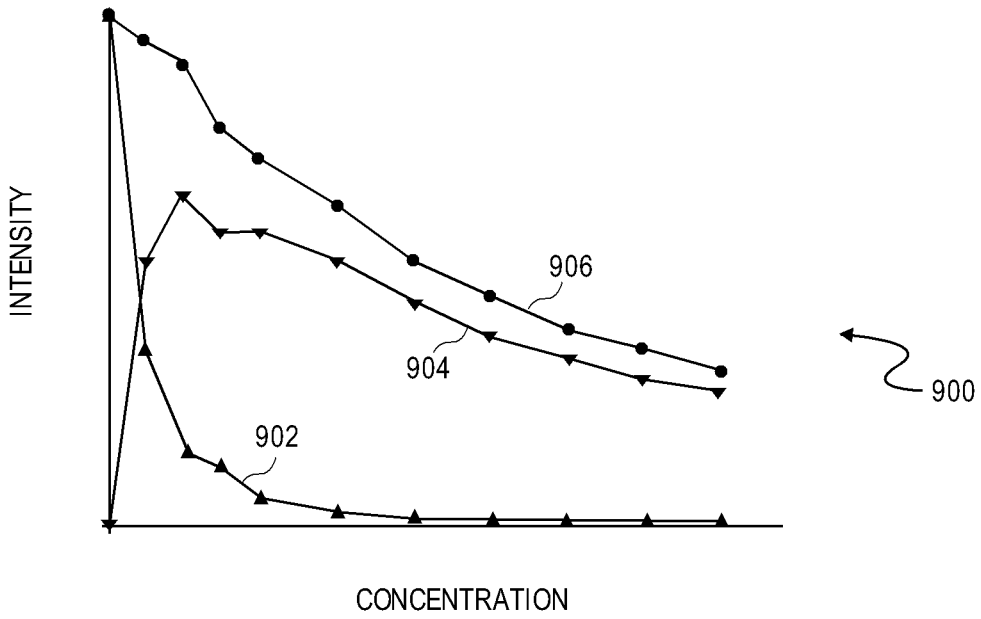
FIGS. 9A and 9B are diagrams of graphs depicting light intensity as a function of colorant concentration, according to an embodiment of the present disclosure.
Figure 9B:
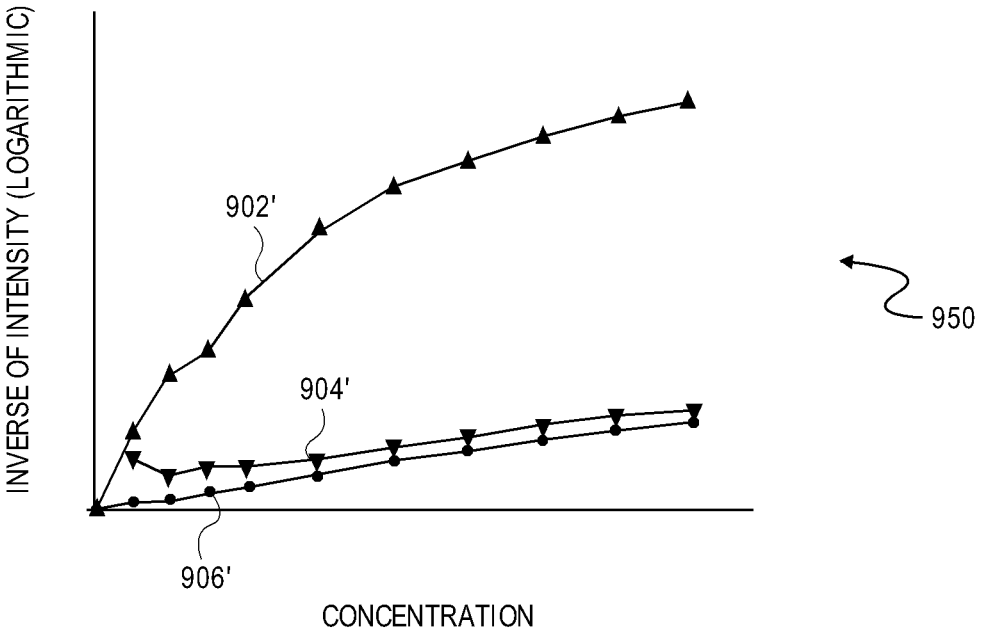

In conclusion, FIGS. 9A and 9B show graph 900 and 950, respectively of detected light intensity as a function of colorant concentration, according to an embodiment of the present disclosure, and which depicts the advantages provided by embodiments of the present disclosure. In FIG. 9A, the graph 900 specifically depicts light intensity as a function of colorant concentration, whereas in FIG. 9B, the graph specifically depicts the logarithm of the inverse of light intensity as a function of colorant concentration. The lines 902 and 902' denote detected light that has not been diverged or absorbed by colorant particles. By comparison, the lines 904 and 904' denote detected light that has been diverged by colorant particles. The lines 906 and 906' denote a weighted sum of the detected light that has not been diverged or absorbed by colorant particles and the light that has been diverged by colorant particles.

It is noted that the lines 902, 902', 904, 904', and 906' are non-linear. Advantageously, however, the line 906' is linear. Thus, employing embodiments of the present disclosure permit a relatively simple linear function to be generated from which colorant concentration can be easily calculated from the light detected by the various detector(s) of embodiments of the present disclosure. Similar and other advantages are provided by embodiments of the present disclosure as well.

For example, first, embodiments of the present disclosure provide for a significantly decrease dependence of the colorant concentration on the nature of the light inclination mechanism of the colorant, such as particle size, shape, and/or refraction index. This means that the light detected by the various detector(s) of embodiments of the present disclosure provides the signal represented by the line 906' in FIG. 9B in particular that depends just on the colorant concentration. As such, colorant concentration determination is simplified.

Second, embodiments of the present disclosure provide for a substantially linear dependence of the logarithm of the inverse of the weighted sum of the detector signals, as has been described above. This permits a significantly simplified process of constructing calibration curves and procedures. For this reason as well, colorant concentration determination is also simplified.

We claim:

1. A detecting apparatus to at least assist in determining a concentration of colorants within a carrier liquid, the colorants at least absorbing light and/or diverging light, comprising:

one or more light sources to emit light; and one or more light detectors to detect light, the light sources and the light detectors positioned in relation to one another such that i) light directly emitted by the light sources that has not been absorbed or diverged by the colorants is detected, and ii) light diverged by the colorants within the carrier liquid is detected, wherein the light diverged by the colorants includes light that is fluoresced and/or scattered by the colorants, wherein the concentration of the colorants is determined based on the light directly emitted by the light sources that has not been absorbed or diverged by the colorants and/or on the light diverged by the colorants within the carrier liquid.

2. The detecting apparatus of claim 1, wherein the detecting apparatus defines a transmitted light path having an emitting end and a detecting end, such that the light directly emitted by the light sources that has not been absorbed or diverged by the colorants is emitted at the emitting end of the transmitted light path and is detected at the detecting end of the transmitted light path.

3. The detecting apparatus of claim 2, further comprising:

one or more first lenses at the emitting end of the transmitted light path; and one or more second lenses at the detecting end of the transmitted light path and situated opposite to the first lenses, such that the first lenses and the second lenses define the transmitted light path.

4. The detecting apparatus of claim 2, wherein the light sources comprise:

one or more first light sources to emit light that travels along the transmitted light path, the first light sources positioned at the emitting end of the transmitted light path, the first light sources positioned along an axis of the transmitted light path, the axis of the transmitted light path running between the emitting end and the detecting end of the transmitted light path; and one or more second light sources to emit light that does not travel along the transmitted light path, the second light sources positioned near the emitting end of the transmitted light path, the second light sources not positioned along the axis of the transmitted light path, wherein the first light sources do not emit any light that does not travel along the transmitted light path unless the light is diverged or absorbed by the colorants, and the second light sources do not emit any light that travels along the transmitted light path.

5. The detecting apparatus of claim 4, wherein the light detectors are positioned at the detecting end of the transmitted light path, and the light detectors are positioned along the axis of the transmitted light path, wherein the light detectors detect the light emitted by the first light sources and that has not been absorbed or diverged by the colorants, and wherein the light detectors detect the light emitted by the second light sources and that has been diverged by the colorants within the carrier liquid.

6. The detecting apparatus of claim 5, wherein the first light sources and the second light sources are alternatingly turned on and off, such that when the first light sources are on the second light sources are off, and when the first light sources are off the second light sources are on, wherein the light detectors detect the light emitted by the first light sources and that has not been absorbed or diverged by the colorants when the first light sources are on and the second light sources are off, and wherein the light detectors detect the light emitted by the second light sources and that has been diverged by the colorants within the carrier liquid when the second light sources are on and the first light sources are off.

7. The detecting apparatus of claim 2, wherein the light sources emit only light that travels along the transmitted light path except where the light is diverged or absorbed by the colorants, the light sources do not emit any light that does not travel along the transmitted light path unless the light is diverged or absorbed by the colorants, the light sources are positioned at the emitting end of the transmitted light path, the light sources are positioned along an axis of the transmitted light path, the axis of the transmitted light path running between the emitting end and the detecting end of the transmitted light path.

8. The detecting apparatus of claim 7, wherein the light detectors comprise:

one or more first light detectors to detect the light emitted by the light sources and that has not been absorbed or diverged by the colorants, the first light detectors positioned at the detecting end of the transmitted light path, the first light detectors positioned along the axis of the transmitted light path; and, one or more second light detectors to detect the light emitted by the light sources and that has been diverged by the colorants within the carrier liquid, wherein the first light detectors do not detect any light that does not travel along the transmitted light path, and the second light detectors do not detect any light that does travel along the transmitted light path.

9. The detecting apparatus of claim 8, wherein the second light detectors are positioned near the detecting end of the transmitted light path, and the second light detectors are not positioned along the axis of the transmitted light axis.

10. The detecting apparatus of claim 8, further comprising a mirror to reflect the light emitted by the light sources and that has been diverged by the colorants within the carrier liquid towards the second light detectors.

11. The detecting apparatus of claim 8, wherein the light sources are all turned on at substantially a same time, such that the first light detectors detect the light emitted by the light sources and that has not been absorbed by the colorants at substantially a same time that the second light detectors detect the light emitted by the light sources and that has been diverged by the colorants within the carrier liquid.

12. A liquid electro-photography (LEP) printing device comprising:

an LEP printing mechanism to print images on media by using LEP in relation to an ink having solid pigment particles within a carrier liquid, the solid pigment particles at least absorbing light and/or diverging light; and a detecting apparatus to at least assist in determining a concentration of the solid pigment particles within the carrier liquid, the detecting apparatus comprising:

one or more light sources to emit light; and one or more light detectors to detect light, the light sources and the light detectors positioned in relation to one another such that the light detectors detect i) light directly emitted by the light sources that has not been absorbed or diverged by the solid pigment particles, and ii) light diverged by the solid pigment particles within the carrier liquid, wherein the light diverged by the solid pigment particles includes light that is fluoresced and/or scattered by the solid pigment particles.

13. The LEP printing device of claim 12, wherein the detecting apparatus defines a transmitted light path having an emitting end and a detecting end, such that the light directly emitted by the light sources that has not been absorbed or diverged by the solid pigment particles is emitted at the emitting end of the transmitted light path and is detected at the detecting end of the transmitted light path.

14. The LEP printing device of claim 13, wherein the light sources comprise:

one or more first light sources to emit light that travels along the transmitted light path, the first light sources positioned at the emitting end of the transmitted light path, the first light sources positioned along an axis of the transmitted light path, the axis of the transmitted light path running between the emitting end and the detecting end of the transmitted light path; and one or more second light sources to emit light that does not travel along the transmitted light path, the second light sources positioned near the emitting end of the transmitted light path, the second light sources not positioned along the axis of the transmitted light path, wherein the first light sources do not emit any light that does not travel along the transmitted light path unless the light is diverged or absorbed by the solid pigment particles, and the second light sources do not emit any light that travels along the transmitted light path, wherein the light detectors are positioned at the detecting end of the transmitted light path, and the light detectors are positioned along the axis of the transmitted light path, wherein the light detectors detect the light emitted by the first light sources and that has not been absorbed or diverged by the solid pigment particles, and wherein the light detectors detect the light emitted by the second light sources and that has been diverged by the solid pigment particles within the carrier liquid.

15. The LEP printing device of claim 13, wherein the light sources emit only light that travels along the transmitted light path except where the light is diverged or absorbed by the solid pigment particles, the light sources do not emit any light that does not travel along the transmitted light path unless the light is diverged or absorbed by the solid pigment particles, the light sources are positioned at the emitting end of the transmitted light path, the light sources are positioned along an axis of the transmitted light path, the axis of the transmitted light path running between the emitting end and the detecting end of the transmitted light path, wherein the light detectors comprise:

one or more first light detectors to detect the light emitted by the light sources and that has not been absorbed or diverged by the solid pigment particles, the first light detectors positioned at the detecting end of the transmitted light path, the first light detectors positioned along the axis of the transmitted light path; and, one or more second light detectors to detect the light emitted by the light sources and that has been diverged by the solid pigment particles within the carrier liquid, wherein the first light detectors do not detect any light that does not travel along the transmitted light path, and the second light detectors do not detect any light that does travel along the transmitted light path.

16. The LEP printing device of claim 15, wherein the detecting apparatus further comprises a mirror to reflect the light emitted by the light sources and that has been diverged by the solid pigment particles within the carrier liquid towards the second light detectors.

17. A method for determining a concentration of colorants within a carrier liquid, the colorants at least absorbing light and/or diverging light, comprising:

positionally configuring one or more light sources and one or more light detectors in relation to one another such that the light detectors detect i) light directly emitted by the light sources that has not been absorbed or diverged by the colorants, and ii) light diverged by the colorants within the carrier liquid, wherein the light diverged by the colorants includes light that is fluoresced and/or scattered by the colorants;

emitting light by the light sources;

detecting light by the light detectors; and processing a measure of the light directly emitted by the light sources that has not been absorbed or diverged by the colorants, as detected, in relation to a measure of the light diverged by the colorants within the carrier liquid, as detected, to determine the concentration of the colorants within the carrier liquid.

18. The method of claim 17, further comprising defining a transmitted light path to have an emitting end and a detecting end, such that the light directly emitted by the light sources that has not been absorbed or diverged by the colorants is emitted at the emitting end of the transmitted light path and is detected at the detecting end of the transmitted light path, wherein positionally configuring the light sources and the light detectors in relation to one another comprises:

positioning one or more first light sources of the light sources at the emitting end of the transmitted light path and along an axis of the transmitted light path, the axis of the transmitted light path running between the emitting end and the detecting end of the transmitted light path;

positioning one or more second light sources of the light sources near the emitting end of the transmitted light path and not along the axis of the transmitted light path, positioning the light detectors at the detecting end of the transmitted light path and along the axis of the transmitted light path, wherein emitting the light by the light sources comprises alternatingly turning the first light sources and the second light sources on and off, such that when the first light sources are on the second light sources are off, and when the first light sources are off the second light sources are on, and wherein detecting the light by the light detectors comprises:

the light detectors detecting the light emitted by the first light sources that has not been absorbed or diverged by the colorants when the first light sources are on and the second light sources are off; and, the light detectors detecting the light emitted by the second light sources that has been diverged by the colorants within the carrier liquid when the second light sources are on and the first light sources are off.

19. The method of claim 17, further comprising defining a transmitted light path having an emitting end and a detecting end, such that light directly emitted by the light sources and that has not been absorbed or diverged by the colorants is emitted at the emitting end of the transmitted light path and is detected at the detecting end of the transmitted light path, wherein positionally configuring the light sources and the light detectors in relation to one another comprises:

positioning the light sources at the emitting end of the transmitted light path and along an axis of the transmitted light path running between the emitting end and the detecting end of the transmitted light path;

positioning one or more first light detectors of the light detectors at the detecting end of the transmitted light path and along the axis of the transmitted light path;

positioning one or more second light detectors of the light detectors near the detecting end of the transmitted light path and not along the axis of the transmitted light path, wherein emitting the light by the light sources comprises turning on all the light sources at a same time, and wherein detecting the light by the light detectors comprises:

the first light detectors detecting the light emitted by the light sources and that has not been absorbed by the colorants; and, the second light detectors detecting the light emitted by the light sources and that has been diverged by the colorants within the carrier liquid, such that the first light detectors detect the light emitted by the light sources and that has not been absorbed by the colorants at substantially a same time that the second light detectors detect the light emitted by the light sources and that has been diverged by the colorants within the carrier liquid.

20. The method of claim 19, further comprising positioning a mirror in relation to the second light detectors to reflect the light emitted by the light sources and that has been diverged by the colorants within the carrier liquid towards the second light detectors.

21. The apparatus of claim 3, wherein the light sources comprise:

one or more first light sources to emit light that travels along the transmitted light path, the first light sources positioned at a focal point of the first lenses at the emitting end of the transmitted light path, and one or more second light sources to emit light that does not travel along the transmitted light path, the second light sources positioned off-center relative to the first lenses at the emitting end of the transmitted light path, wherein the first light sources do not emit any light that does not travel along the transmitted light path unless the light is diverged or absorbed by the colorants, and the second light sources do not emit any light that travels along the transmitted light path.

22. The apparatus of claim 1 wherein:

the detecting apparatus defines a transmitted light path having an emitting end and a detecting end; and at least one of the light sources or at least one of the light detectors is not positioned along an axis of the transmitted light path.

* * * * *